US010865070B2

(12) United States Patent
Helenius

(10) Patent No.: US 10,865,070 B2
(45) Date of Patent: Dec. 15, 2020

(54) ROPE, ROPE ARRANGEMENT AND HOISTING DEVICE

(71) Applicant: Kone Corporation, Helsinki (FI)

(72) Inventor: Juha Helenius, Helsinki (FI)

(73) Assignee: Kone Corporation, Helsinki (FI)

( * ) Notice: Subject to any disclaimer, the term of this patent is extended or adjusted under 35 U.S.C. 154(b) by 326 days.

(21) Appl. No.: 15/830,343

(22) Filed: Dec. 4, 2017

(65) Prior Publication Data

US 2018/0186604 A1 Jul. 5, 2018

(30) Foreign Application Priority Data

Dec. 29, 2016 (EP) ..... 16207296

(51) Int. Cl.

| | |
|---|---|
| ***B66B 7/06*** | (2006.01) |
| ***D07B 1/16*** | (2006.01) |
| ***D07B 5/00*** | (2006.01) |
| ***D07B 1/00*** | (2006.01) |
| ***D07B 1/22*** | (2006.01) |

(52) U.S. Cl.

CPC ..... *B66B 7/062* (2013.01); *D07B 1/005* (2013.01); *D07B 1/162* (2013.01); *D07B 1/22* (2013.01); *D07B 5/006* (2015.07); *D07B 2201/2087* (2013.01); *D07B 2501/2007* (2013.01); *D10B 2401/063* (2013.01)

(58) Field of Classification Search

CPC B66B 7/062; D07B 2501/2007; D07B 5/006; B07B 1/22

See application file for complete search history.

(56) References Cited

U.S. PATENT DOCUMENTS

| | | | | |
|---|---|---|---|---|
| 9,758,345 | B2 * | 9/2017 | Ach | B66B 7/062 |
| 2010/0133046 | A1 * | 6/2010 | Allwardt | B66B 7/062 187/251 |
| 2015/0101888 | A1 * | 4/2015 | Pelto-Huikko | B66B 7/062 187/251 |

* cited by examiner

*Primary Examiner* — Diem M Tran

(74) *Attorney, Agent, or Firm* — Harness, Dickey and Pierce, P.L.C.

(57) ABSTRACT

A belt-shaped rope of a hoisting device, the rope being substantially larger in its width-direction than thickness-direction, and comprising two or more load bearing members; a coating forming an outer surface of the rope, in which coating the two or more load bearing members are embedded, wherein the two or more load bearing members are oriented to extend parallel with longitudinal direction of the rope adjacent each other in width direction of the rope such that a gap is formed in width direction between load bearing members next to each other, the coating extending into the gap. The coating comprises a first coating portion between load bearing members next to each other, and a second coating portion forming an outer side of the rope facing in thickness direction of the rope, and in that the material of the first coating portion is substantially harder than the material of the second coating portion.

14 Claims, 3 Drawing Sheets

ROPE, ROPE ARRANGEMENT AND HOISTING DEVICE

This application claims priority to European Patent Application No. EP16207296.1 filed on Dec. 29, 2016, the entire contents of which are incorporated herein by reference.

FIELD OF THE INVENTION

The invention relates to a rope of a hoisting device, such as an elevator for vertically transporting passengers and/or goods.

BACKGROUND OF THE INVENTION

In hoisting devices, hoisting ropes can be used for suspending the load to be hoisted. In an elevator, the load is in the form of an elevator car vertically movable in a hoistway. The hoisting ropes are normally arranged to suspend the elevator car as well as a counterweight on opposite sides of one or more rope wheels around which the rope passes.

In hoisting devices, such as elevators, there are typically plurality of said hoisting ropes passing alongside each other. The conventional elevators have steel ropes, but some elevators have belt-shaped ropes which are substantially larger in their width-direction than thickness-direction. As with any other kind of ropes, position of belt-shaped ropes relative to the rope wheel around which they pass needs to be controlled so that none of the ropes drifts in axial direction of the rope wheel away from the circumferential surface area of the rope wheel against which the rope in question is intended to rest.

Each hoisting rope typically includes one or more load bearing members which are elongated in the longitudinal direction of the rope, each forming a structure that continues unbroken throughout the length of the rope. Load bearing members are the members of the rope which are able to bear together the load exerted on the rope in its longitudinal direction. The load, such as a weight suspended by the rope, causes tension on the load bearing member, which tension can be transmitted by the load bearing member in question all the way from one end of the rope to the other end of the rope. Ropes may further comprise non-bearing components, such as a coating, which cannot transmit tension in the above described way. The coating can be utilized for protection of the load bearing members and/or facilitating contact with rope wheels and/or for positioning adjacent load bearing members relative to each other, for example. It is relevant for safety that when the rope is to be driven with a frictional engagement, the coating material must have such a friction coefficient that it engages firmly with a drive wheel.

In prior art, position of belt-shaped ropes in said axial direction has been controlled by providing the rope wheel and the rope engaging the rope wheel with a ribbed or toothed shapes complementary to each other, whereby movement of the rope in said axial direction is blocked by mechanical shape-locking. One alternative way to control position of the belt-shaped ropes in said axial direction is to shape the circumferential surface areas of the drive wheel crowned (also known as cambered). Each crowned circumferential surface area has a convex shape against the peak of which the rope rests. The crowned shape tends to keep the belt-shaped rope passing around it to be positioned such that it rests against the peak thereof, thereby resisting displacement of the rope far away from the point of the peak.

A drawback of the known elevators has been that crowning-based guidance solutions have not been able to control position of belt shaped ropes sufficiently well. Practical experience has shown that crowning-based guidance of belt shaped ropes can be very sensitive to a wide range of inaccuracies. For example, existence of a fleet angle or pulley misalignment less than 0.1° is adequate in some occasions to lead a belt-shaped rope out of its intended position on the crowned rope wheel. Building sway might also easily throw ropes out of their intended position on the crowned rope wheel.

BRIEF DESCRIPTION OF THE INVENTION

The object of the invention is to introduce a new rope arrangement of a hoisting device, rope arrangement arrangement of a hoisting device and a hoisting device, wherein the rope is improved in terms of its suitability for being guided by a crowned circumference of a rope wheel around which it passes. An object is to introduce a solution by which one or more of the above defined problems of prior art and/or problems discussed or implied elsewhere in the description can be solved. Embodiments are presented, inter alia, where a rope guided by a crowned rope wheel circumference stays more easily and reliably in its intended position on the crowned circumference, and its tolerance for inaccuracies existing in the rest of the components of the hoisting device is increased while at the same time maintaining capacity for a very firm engagement with a drive wheel of the hoisting device.

The aforementioned drawbacks have been noted to be particularly relevant when the rope structure is demanding and the manufacturing process does not produce adequately symmetrical and similar ropes. Replacing only one rope in an elevator might be difficult, since ropes from different manufacturing batches tend to run on different locations on crowning. Slight variation in positioning of the load bearing members within the rope cross section can occur among batches. Slight variation of this kind is likely when the load bearing members are not round, but rectangular for instance, because in these cases the load bearing member location and attitude are potential causes of variations within individual ropes and between ropes. These challenges are present for example with ropes having load bearing members made of composite material as the position of adjacent composite members is difficult to control precisely when they are embedded in a coating in the manufacturing process. An object of the invention is furthermore to provide solution which can alleviate one or more of these challenges.

It is brought forward a new belt-shaped rope of a hoisting device, the rope being substantially larger in its width-direction than thickness-direction, and comprising two or more load bearing members; a coating forming an outer surface of the rope, in which coating the two or more load bearing members are embedded, wherein the two or more load bearing members are oriented to extend parallel with longitudinal direction of the rope throughout the length thereof adjacent each other in width direction of the rope such that a gap is formed in width direction between load bearing members next to each other, the coating extending into the gap. The coating comprises a first coating portion between load bearing members next to each other, and a second coating portion forming an outer side of the rope facing in thickness direction of the rope, and the material of the first coating portion is substantially harder than the material of the second coating portion. With this solution one or more of the above mentioned objects can be achieved. The relatively hard first coating portion being placed between load bearing members increases rope flexural rigidity and therefore decreases rope displacement from the crowning centreline. The second coating portion of lower hardness being placed to form the rope outer side surface provides the rope with sufficient friction for engagement with a rope wheel. Thereby the rope can be guided with crowned rope wheel with firm frictional engagement. Preferable further details are introduced in the following, which further details can be combined with the rope individually or in any combination.

In a preferred embodiment, the first coating portion between load bearing members next to each other is bonded with both of the load bearing members next to each other coupling these to each other.

In a preferred embodiment, the first coating portion between load bearing members next to each other is a solid one-piece structure extending between the load bearing members next to each other throughout their lengths.

In a preferred embodiment, the load bearing members are isolated from each other by the coating.

In a preferred embodiment, the belt-shaped rope is suitable for being guided by a crowned circumference of a rope wheel. Particularly, it is preferred that said outer side of the rope facing in thickness direction of the rope and formed by the second coating portion is suitable for being placed against a crowned circumference of a rope wheel. For this purpose, it is preferred that said outer side is substantially smooth. The smooth outer side is particularly preferably shaped to be without teeth or longitudinal ribs protruding in thickness direction of the rope.

In a preferred embodiment, each said load bearing member is substantially larger in width-direction of the rope than in thickness-direction of the rope.

In a preferred embodiment, each said load bearing member is non-circular. With this cross-sectional characteristic, increased sensitivity to inaccuracies in positioning of the load bearing members is relatively likely. In context of this one characteristic the proposed composition of the coating is advantageous as it reduces likelihood of said inaccuracies.

In a preferred embodiment, the width/thickness ratio of each said load bearing member is two or more.

In a preferred embodiment, the width/thickness ratio of the rope is two or more, preferably more than 4.

In a preferred embodiment, each said load bearing member is shaped to have at least one planar side face. The load bearing member can comprise a side face that extends parallel with the width direction of the rope and/or a side face that extends parallel with the thickness direction of the rope. The load bearing member can be rectangular in cross section, the corners possibly being rounded. With these cross-sectional characteristics, increased sensitivity to inaccuracies in positioning of the load bearing members is relatively likely. In context of one or more of these characteristics the proposed composition of the coating is advantageous as it reduces likelihood of said inaccuracies.

In a preferred embodiment, each said load bearing member is made of composite material comprising reinforcing fibers embedded in polymer matrix, said reinforcing fibers preferably being carbon fibers or glass fibers.

In a preferred embodiment, the reinforcing fibers of each load bearing member are distributed in the polymer matrix of the load bearing member in question and bound together by it. The reinforcing fibers of each load bearing member are then preferably substantially evenly distributed in the polymer matrix of the load bearing member in question. Furthermore, preferably, over 50% of the cross-sectional square area of the load bearing member consists of said reinforcing fibers. Thereby, a high tensile stiffness can be facilitated.

In a preferred embodiment, the second coating portion covers the first coating portion in thickness direction of the rope.

In one kind of a preferred embodiment, the first coating portion is completely encapsulated within the rope. Then, it is preferable that the second coating portion forms the whole outer surface of the rope. In another kind of a preferred embodiment, the first coating portion and the second coating portion form opposite outer sides of the rope facing in thickness direction of the rope.

In a preferred embodiment, the first coating portion is made of a material having a first Shore A hardness, and said second coating portion is made of material having a second Shore A hardness.

In a preferred embodiment, the first Shore A hardness is more than Shore A 85. The first Shore A hardness is however preferably less than Shore A 100, more preferably less than Shore A 96. With these ranges the coupling effect is most advantageous while other properties of the rope affecting its usability, such as its bendability, are not substantially compromised.

In a preferred embodiment, the second Shore A hardness is less than said first Shore A hardness.

In a preferred embodiment, the second Shore A hardness is at most Shore A 85.

In a preferred embodiment, the first coating portion and said second coating portion are both made of polymer material.

In a preferred embodiment, the first coating portion is made of polyurethane having a first Shore A hardness, and said second coating portion is made of polyurethane having a second Shore A hardness.

In a preferred embodiment, the module of elasticity E of the polymer matrix is over 2 GPa, more preferably over 2.5 GPa, and less than 10 GPa, most preferably in the range 2.5-4.5 GPa.

In a preferred embodiment, the first coating portion fills the gap between the load bearing members next to each other.

In a preferred embodiment, the load bearing members next to each other are embedded in the first coating portion, and out of contact with the second coating portion. In a further refined embodiment all the load bearing members of the rope are embedded in the first coating portion, and out of contact with the second coating portion.

In a preferred embodiment, the first coating portion and the load bearing members next to each other are surrounded by the second coating portion.

In a preferred embodiment, the second coating portion is bonded with the first coating portion.

In a preferred embodiment, the first coating portion and the second coating portion have been formed by co-extrusion.

In a preferred embodiment, the rope comprises more than two load bearing members. Thereby there are more than one of the aforementioned gaps formed in width direction between load bearing members next to each other. Moreover, for this reason there are more than one pairs of load bearing members that are next to each other. Preferably, the coating comprises an aforementioned first coating portion extending within each of the gaps of the rope which are formed in width direction between load bearing members next to each other. In one kind of preferred embodiment, the first coating portions extending within different gaps form pieces of first coating portion material which pieces are separate from each other. In another kind of preferred embodiment, the first coating portions extending within different gaps are parts of the same piece of first coating portion material. Generally, although it is possible, it is preferable that the rope does not contain more than 10 of said load bearing members.

In a preferred embodiment, the side of the rope opposite to the aforementioned side formed by the second coating portion, is contoured to have an uneven surface pattern, such as a rib or tooth pattern. This is not necessary, but then, this contoured side, e.g. with a grooved or toothed shape can pass around a circumference of a rope wheel which circumference has an uneven surface pattern forming a counterpart for the uneven surface pattern of the contoured side. This makes the rope suitable for being guided from different sides by different guiding principles, and with optimized surface properties for contacting a rope wheel. The optimizing can be implemented by utilizing one of the coating portions for forming the outer surface of the side with uneven surface pattern. The outer side of the rope facing in thickness direction of the rope, which side is opposite to the aforementioned outer side formed by the second coating portion, is contoured to have an uneven surface pattern, most preferably a rib pattern, particularly comprising ribs and grooves that are elongated in longitudinal direction of the rope. In one kind of embodiment the outer side of the rope facing in thickness direction of the rope, which side is opposite to the aforementioned outer side, and contoured to have an uneven surface pattern, is formed by the second coating portion, whereby the uneven surface pattern is formed by the second coating portion. Thus, the uneven surface pattern is in these embodiments formed of relatively soft material. In an embodiment of another kind, the outer side of the rope facing in thickness direction t of the rope, which side is opposite to the aforementioned outer side formed by the second coating portion, and contoured to have an uneven surface pattern, is formed by the first coating portion, whereby the uneven surface pattern is formed by the first coating portion. Thus, the uneven surface pattern is in this embodiment formed of relatively hard material.

It is also brought forward a new rope arrangement of a hoisting device comprising one or more belt-shaped ropes passing around one or more crowned rope wheels resting against a crowned circumferential surface area thereof, wherein said one or more belt-shaped ropes are as defined anywhere above.

In a preferred embodiment of the rope arrangement of a hoisting device, said one or more rope wheels include a drive wheel rotatable by a motor.

In a preferred embodiment of the rope arrangement of a hoisting device, each of said one or more belt-shaped ropes passes around a crowned rope wheel such that its outer side facing in thickness direction of the rope which outer side is formed by the second coating portion rests against a crowned circumferential surface area of the rope wheel. The rope wheel is preferably a drive wheel rotatable by a motor.

In a preferred embodiment of the rope arrangement of a hoisting device, said rope is connected with a load to be hoisted. Said load can be an elevator car if the hoisting device is an elevator. Should the hoisting device be some other kind of device, such as a crane, the load can be any other kind of load.

In a preferred embodiment of the rope arrangement of a hoisting device, the hoisting device is an elevator for transporting passengers and/or goods and said load is an elevator car suitable for accommodating passengers and/or goods and vertically movable in a hoistway.

In a preferred embodiment of the rope arrangement of a hoisting device, the side of the rope opposite to the aforementioned side formed by the second coating portion is contoured to have an uneven surface pattern, such as a rib or tooth pattern, and said side of the rope contoured to have an uneven surface pattern is arranged to rest against a circumference of a rope wheel which circumference has an uneven surface pattern forming a counterpart for the uneven surface pattern of the rope.

It is also brought forward a new hoisting device comprising a rope arrangement as defined anywhere above, wherein said rope is connected with a load to be hoisted.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
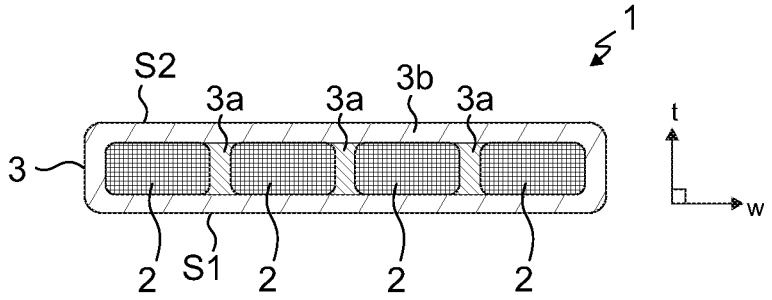
FIG. 1 illustrates the cross-section of a first preferred embodiment of a rope according to the invention.
Figure 2:
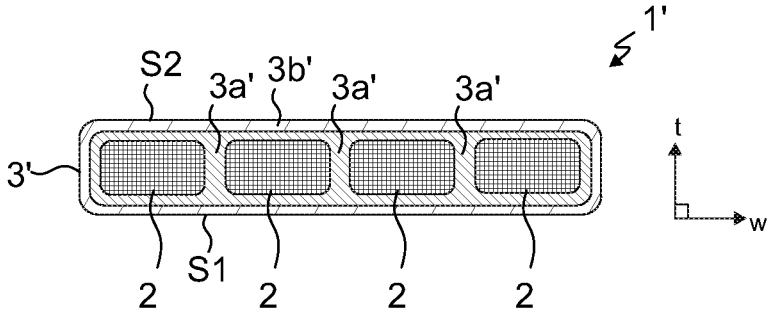
FIG. 2 illustrates the cross-section of a second preferred embodiment of a rope according to the invention.
Figure 3:
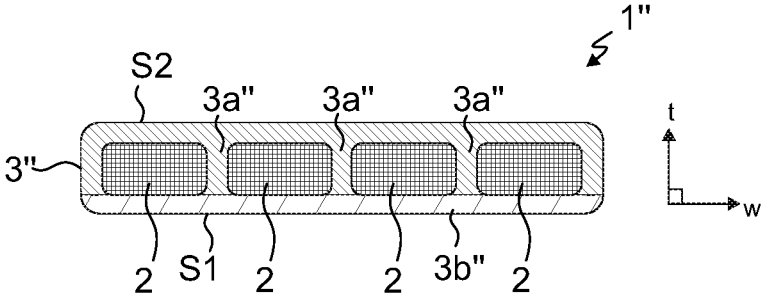
FIG. 3 illustrates the cross-section of a third preferred embodiment of a rope according to the invention.

FIGS. 1, 2 and 3 illustrate preferred embodiments of a belt-shaped rope 1, 1', 1" of a hoisting device. The rope 1, 1', 1" is in each case substantially larger in its width-direction w than thickness-direction t, and comprises load bearing members 2, and a coating 3,3',3" forming an outer surface of the rope 1, 1', 1" in which coating 3,3',3" the load bearing members 2 are embedded. The coating 3,3',3" is advantageous as it provides protection for the load bearing members 2 and facilitates contact with rope wheels and positions adjacent load bearing members 2 relative to each other.

The number of the load bearing members 2 is in the illustrated examples four, however the number could be some other albeit at least two. Having plurality of load bearing members 2 instead of a larger one may be seen advantageous for various reasons. For instance, in this way sensitivity to cracking can be reduced.

The load bearing members 2 are oriented to extend parallel with longitudinal direction of the rope 1, 1', 1" throughout the length thereof adjacent each other in width direction w of the rope 1, 1', 1" such that a gap is formed in width direction between each two load bearing members 2 next to each other, the coating 3, 3', 3" extending into the gap and filling it. The load bearing members 2 are placed such that their central axes are on a same plane extending in width direction of the rope 1, 1', 1". The coating 3, 3', 3" comprises a first coating portion 3*a*; 3*a*', 3*a*" that is in width direction of the rope 1,1', 1" between load bearing members 2 that are next to each other, and a second coating portion 3*b*; 3*b*'; 3*b*" forming an outer side S1 of the rope 1, 1', 1" facing in thickness direction of the rope. The material of the first coating portion 3*a*;3*a*';3*a*" is substantially harder than the material of the second coating portion 3*b*; 3*b*'; 3*b*". In this way, structure of the coating becomes optimized for the sub tasks which its different portions have as will be described in further details hereinafter.

The hard first coating portion 3*a*,3*a*',3*a*" being placed between load bearing members increases rope flexural rigidity EI and therefore decreases rope displacement from the crowning centreline as predicted by equation 1 and shown by tests. The centerline is at the point of the peak of the convex shape of the crowned circumferential surface area. The second coating portion 3*b*; 3*b*'; 3*b*" of lower hardness being placed on the rope surface provides the rope 1, 1', 1" with sufficient friction.

In guidance of a belt shaped coated rope by a crowned shaped of a rope wheel, the rope settles to its equilibrium position which may be approximated by equation $$z = R_{cr}\tan(\alpha)R\sqrt{\frac{F}{EI}} \tag{1}$$

where z is the displacement of rope from crowning centreline $R_{cr}$ is crowning radius $\alpha$ is fleet angle R is pulley radius F is rope force EI is the flexural rigidity of rope.

The flexural rigidity EI appearing in the equation 1 is determined by rope cross section dimensions and material properties. In particular, EI is affected by load Young's modulus E of the bearing members and mutual coupling between them. The difference between zero coupling and rigid coupling is significant. In practice, the coupling is never neither zero nor rigid, but somewhere in between them. The rigidity of the coupling is affected especially by the material properties of the coating between the load bearing members. This is due to the fact that load transfer in structures occurs primarily through the most rigid path. The parts of the coating on the rope surface doesn't affect very much on the coupling between load bearing members. Based on the above description, sufficient friction and improved guidance for the belt-shaped rope to be guided by a crowned rope wheel is achieved by combining two or more coating portions of different hardnesses. The first and second coating portions 3*a*,3*a*',3*a*";3*b*,3*b*',3*b*" can be for instance grades of thermoplastic polyurethane (TPU) with different hardnesses.

Generally, the friction of a coated belt-shaped rope is affected by contact surfaces of rope and rope wheel. The stiffer and harder the coating, the lower is the coefficient of friction if other things (e.g. surface quality) remain constant. If the coating is too hard, elevator-level T1/T2 requirements on the drive wheel are not met. This may be disadvantageous in terms of reliability of the grip and safety. The friction decreases significantly over time since chemical changes occur in and dirt is embedded in the rope surface.

In the preferred embodiments of FIGS. 1, 2 and 3, the load bearing members 2 are isolated from each other by the coating 3,3',3". Particularly, it blocks them from touching each other. In the preferred embodiments of FIGS. 1, 2 and 3, the first coating portion 3*a*;3*a*';3*a*" between load bearing members 2 next to each other is bonded with both of the load bearing members 2 next to each other coupling these to each other. As for its structure, the first coating portion 3*a*;3*a*';3*a*" between load bearing members 2 next to each other is a solid one-piece structure that extends between the load bearing members 2 next to each other throughout their lengths.

Figure 4:
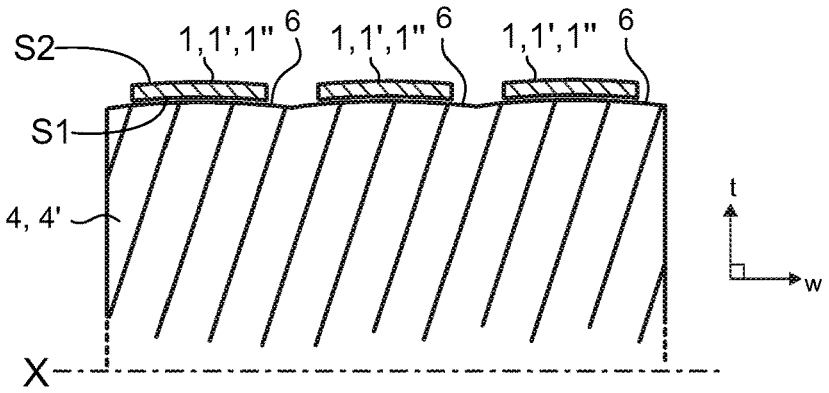
FIG. 4 illustrates a rope arrangement of a hoisting device comprising belt-shaped hoisting ropes passing around a crowned rope wheel.

In the preferred embodiments of FIGS. 1, 2 and 3, the belt-shaped rope 1,1', 1" is suitable for being guided by a crowned circumference of a rope wheel such as the of a rope wheel 4,4' illustrated in FIG. 4.

Said outer side S1 of the rope 1,1', 1" facing in thickness direction t of the rope 1,1', 1" and formed by the second coating portion 3*b*; 3*b*'; 3*b*" is suitable for being placed against a crowned circumference 6 of a rope wheel 4,4'. Said side is substantially smooth and shaped to be without teeth or longitudinal ribs protruding in thickness direction t of the rope 1,1',1".

Preferably, each said load bearing member 2 is non-circular, preferably substantially larger in width-direction w of the rope 1,1',1" than in thickness-direction t of the rope 1,1',1". The coating portions of different hardnesses are particularly preferable with ropes having load bearing members of this shape, as the load bearing members are likely to be difficult to position symmetrically, because symmetry of the cross-section is sensitive to tilt or twist of the load bearing members 2. Slight tilt or twist of a wide load bearing member 2 may result in differences between individual ropes and ropes of different batches. Generally, challenges of guidance of ropes with inaccuracies such as slight tilt of the load bearing members 2 can be facilitated with the presented solution as it reduces sensitivity of the guidance to such inaccuracies.

Generally, a wide structure of the load bearing member 2 facilitates its bending. This is particularly relevant with rigid material such as the composite as described elsewhere in this application. The width/thickness ratio of each said load bearing member 2 is preferably two or more.

The width/thickness ratio of the rope is preferably two or more, preferably more than 4. Thus, a single rope with good load bearing ability and bendability can be achieved even with load bearing members 2 made of rigid material such as the composite as described elsewhere in this application.

Each said load bearing member 2 can be shaped to have a planar side face or plurality of them, as illustrated. The cross section of the load bearing member 2 is preferably, but not necessarily, furthermore such that each said load bearing member 2 can be shaped to have at least one planar side face that extends parallel with the width direction of the rope 1,1', 1". In the preferred embodiments, the load bearing member 2 comprises also a planar side face that extends parallel with the thickness direction of the rope 2. As for its overall shape, the load bearing members 2 of the preferred embodiments are rectangular in cross section with their corners rounded.

The load bearing members 2 are made of material different than the first and second coating portion 3*a*;3*a*';3*a*",3*b*; 3*b*';3*b*" of the coating 3,3',3". It is preferred that each said load bearing member 2 is made of composite material comprising reinforcing fibers f embedded in polymer matrix m, said reinforcing fibers f preferably being carbon fibers or glass fibers. Due to the demanding nature of a composite material of this kind, load bearing members 2 of this kind of material are advantageous to provide with a coating, but also to shape non-circular which makes them sensitive to inaccuracies in their positioning.

In the preferred embodiments, the second coating portion 3*b*; 3*b*'; 3*b*" covers the first coating portion 3*a*;3*a*';3*a*" in thickness direction t of the rope 1,1', 1".

Hereinafter, preferred further details of the material properties are described. The hardness is in the following discussed referring to Shore A hardness scale. Accordingly, it is preferred that the first coating portion 3*a*;3*a*';3*a*" is made of a material having a first Shore A hardness, and said second coating portion 3*b*; 3*b*'; 3*b*" is made of material having a second Shore A hardness. Preferably then, the first Shore A hardness is more than Shore A 85, and less than Shore A 100. Then, the second Shore A hardness is less than said first Shore A hardness, but preferably the second Shore A hardness is at most Shore A 85, because this way the frictional properties thereof are suitable for friction based engagement of most drive wheels of hoisting devices such as elevators in particular.

Hereinafter, preferred further details of the materials are described. Preferably, the first coating portion 3*a*;3*a*';3*a*" and said second coating portion 3*b*; 3*b*';3*b*" are both made of polymer material, and advantageously having material properties particularly as described in the preceding paragraph. Most preferably, the first coating portion 3*a*;3*a*';3*a*" is made of polyurethane having a first Shore A hardness, and said second coating portion 3*b*; 3*b*'; 3*b*" is made of polyurethane having a second Shore A hardness. Material properties of polymer materials can be simply adjusted to a desired hardness e.g. by additives mixed with a base polymer, as it is commonly known in the field.

In the embodiment of FIG. 1, the first coating portion 3*a* is completely encapsulated within the rope 1. The second coating portion 3*b* forms the whole outer surface of the rope 1, as illustrated in FIG. 1. The embodiment is further such that, the first coating portion 3*a* between the load bearing members 2 next to each other has a planar side surface facing in thickness direction t of the rope 1, which planar side surface is in thickness direction t of the rope 1 level with the side surfaces of the load bearing members 2 next to each other which face in thickness direction t of the rope 1. The side surfaces of the load bearing members 2 next to each other and the side surface of the first coating portion 3*a* between the load bearing members 2 next to each other together form a planar surface facing in thickness direction t of the rope 1. The first coating portion 3*a* preferably fills the gap between the load bearing members 2 next to each other, as illustrated. The first coating portion 3*a* and the load bearing members 2 next to each other are surrounded by the second coating portion 3*b*. The second coating portion 3*b* is bonded with the load bearing members 2 next to each other and the first coating portion 3*a* between the load bearing members 2 next to each other. The rope 1 with a cross-section presented in FIG. 1 may advantageously be manufactured so that the load bearing members 2 are supported e.g. against a rigid plane inside the extrusion die when hard material of the first coating proportion 3*a*, e.g. TPU, is being extruded in between them. This way the load bearing members 2 are attached together and aligned precisely in the same plane before extruding the second coating portion 3*b*. Since positioning of the load bearing members 2 within the cross-section of the rope 1 can be controlled more precisely, ropes coming from different manufacturing batches are physically similar and run on the same location on crowning. Therefore it's possible to mix different rope batches in a single hoisting device (e.g. elevator) and replacement of only one rope becomes easier. As mentioned, the rope 1 could comprise only two load bearing members 2 adjacent each other in width direction w of the rope 1. However, it is advantageous that there are plurality of load bearing members 2 adjacent each other in width direction w of the rope 1, e.g. so as to reduce sensitivity to longitudinal cracks. The embodiment of FIG. 1 is such that the rope 1 comprises more than two load bearing members 2. Thereby there are more than one of the aforementioned gaps formed in width direction between load bearing members 2 next to each other. Moreover, for this reason there are more than one pairs of load bearing members 2 that are next to each other. In this embodiment, the coating 3 comprises an aforementioned first coating portion 3*a* extending within each of the gaps of the rope 1 which are formed in width direction between load bearing members 2 next to each other. In this embodiment, the first coating portions 3*a* extending within different gaps are pieces separate from each other. This provides that a first coating portion 3*a* with relatively hard material properties is primarily placed in the position most important for coupling the neighboring load bearing members 2 with each other.

In the embodiment of FIG. 2, the first coating portion 3*a*' is completely encapsulated within the rope 1'. The second coating portion 3*b*' forms the whole outer surface of the rope 1', as illustrated in FIG. 2. This embodiment is further such that the load bearing members 2 next to each other are embedded in the first coating portion 3*a*', and out of contact with the second coating portion 3*b*'. The first coating portion 3*a*' isolates load bearing members 2 next to each other from the second coating portion 3*b*'. The first coating portion 3*a*' between load bearing members 2 next to each other is bonded with both of the load bearing members 2 that are next to each other, coupling these to each other. The second coating portion 3*b*' is bonded with the first coating portion 3*a*'. The first coating portion 3*a*' and the load bearing members 2 embedded therein are all embedded in the second coating portion 3*b*' surrounding the first coating portion 3*a*' and the load bearing members 2 embedded therein. As mentioned, rope 1' could comprise only two load bearing members 2 adjacent each other in width direction w of the rope 1'. However, it is advantageous that there are plurality of load bearing members 2 adjacent each other in width direction w of the rope 1', as presented, e.g. so as to reduce sensitivity to longitudinal cracks. The embodiment of FIG. 1 is such that the rope 1' comprises more than two load bearing members 2. Thereby there are more than one of the aforementioned gaps formed in width direction between load bearing members 2 next to each other. Moreover, for this reason there are more than one pairs of load bearing members 2 that are next to each other. In this embodiment, the coating 3' comprises an aforementioned first coating portion 3*a*' extending within each of the gaps of the rope 1', which gaps are formed in width direction between load bearing members 2 next to each other. In the embodiment presented, all the load bearing members 2 of the rope are embedded in the first coating portion 3*a*', and out of contact with the second coating portion 3*b*'. The first coating portion 3*a*' extends between load bearing members 2 of each pair of load bearing members 2 that are next to each other, and it is bonded with all the load bearing members 2 of the rope 1' coupling these to each other. In this embodiment, the first coating portions 3*a*' extending within different gaps are parts of the same piece of first coating portion 3*a*'.

In the embodiment of FIG. 3, the first coating portion 3*a*" and the second coating portion 3*b*" form opposite outer sides S1, S2 of the rope 1" facing in thickness direction t of the rope 1". With the presented cross-section, a rigid coupling between the load bearing members 2 next to each other can be provided, while ensuring with the relatively soft side S1 that the rope 1" has sufficiently high friction coefficient for frictional engagement with a drive wheel. The particular cross-section is simple to manufacture, and it is particularly well suitable for solutions where requirements of frictional properties are critical on only one side S1 of the rope 1". The embodiment is further such that, the first coating portion 3*a*" between the load bearing members 2 next to each other has a planar side surface facing in thickness direction t of the rope 1" (downwards in FIG. 3), which planar side surface is in thickness direction t of the rope 1" level with the side surfaces of the load bearing members 2 next to each other which face in thickness direction t of the rope 1". The side surfaces of the load bearing members 2 next to each other and the side surface of the first coating portion 3*a*" between the load bearing members 2 next to each other together form a planar surface facing in thickness direction t of the rope 1". The first coating portion 3*a*" preferably fills the gap between the load bearing members 2 next to each other, as illustrated. Both the first coating portion 3*a* and the second coating portion 3*b*" are bonded with the load bearing members 2 next to each other. The rope 1" with a cross-section presented in FIG. 1 may advantageously be manufactured so that the load bearing members 2 are supported e.g. against a rigid plane inside the extrusion die when hard material of the first coating proportion 3*a*", e.g. TPU, is being extruded in between them. This way the load bearing members 2 are attached together and aligned precisely in the same plane before extruding the second coating portion 3*b*". Since positioning of the load bearing members 2 within the cross-section of the rope 1" can be controlled more precisely, ropes coming from different manufacturing batches are physically similar and run on the same location on crowning. Therefore, it's possible to mix different rope batches in a single hoisting device (e.g. elevator) and replacement of only one rope becomes easier. As mentioned, the rope 1" could comprise only two load bearing members 2 adjacent each other in width direction w of the rope 1. However, it is advantageous that there are plurality of load bearing members 2 adjacent each other in width direction w of the rope 1", e.g. so as to reduce sensitivity to longitudinal cracks. The embodiment of FIG. 1 is such that the rope 1" comprises more than two load bearing members 2. Thereby there are more than one of the aforementioned gaps formed in width direction between load bearing members 2 next to each other. Moreover, for this reason there are more than one pairs of load bearing members 2 that are next to each other. In this embodiment, the coating 3" comprises an aforementioned first coating portion 3*a*" extending within each of the gaps of the rope 1" which are formed in width direction between load bearing members 2 next to each other. The first coating portion 3*a*' extends between load bearing members 2 of each pair of load bearing members 2 that are next to each other, and it is bonded with all the load bearing members 2 of the rope 1" coupling these to each other. In this embodiment, the first coating portions 3*a*" extending within different gaps are parts of the same piece of first coating portion 3*a*".

FIG. 4 illustrates a rope arrangement of a hoisting device, such as an elevator, comprising belt-shaped hoisting ropes 1, 1', 1" passing around a crowned rope wheel 4,4' resting against a crowned circumferential surface area 6 thereof. Each crowned circumferential surface area 6 has a convex shape against the peak of which a belt-shaped hoisting ropes 1, 1', 1" rope rests. Said belt-shaped hoisting ropes 1, 1, 1" are as illustrated in and described earlier above with reference to FIGS. 1 and 2. Said rope wheel 4,4' can be either a freely rotating non-driven rope wheel 4 or a drive wheel 4 rotatable by a motor M. Said rope 1,1', 1" is preferably connected with a load to be hoisted, such as with an elevator car 5.

Figure 5:
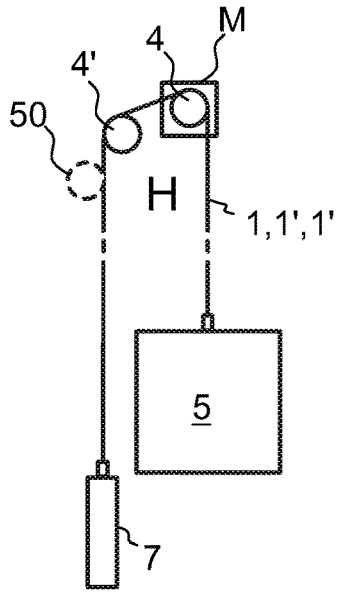
FIG. 5 illustrates a hoisting device in the form of an elevator.

FIG. 5 illustrates a hoisting device particularly an elevator for transporting passengers and/or goods, the hoisting device comprising a rope arrangement comprising belt-shaped hoisting ropes 1, 1', 1" passing around crowned rope wheels 4,4' resting against a crowned circumferential surface area 6 thereof. The belt-shaped hoisting ropes 1, 1', 1" are as illustrated in and described earlier above with reference to FIG. 1, 2 or 3, and they pass around each rope wheel 4,4' in accordance to what is illustrated in and described with reference to FIG. 4. Said rope 1,1', 1' is connected with a load to be hoisted, the load being here an elevator car 5. The elevator car 5 is suitable for accommodating passengers and/or goods and vertically movable in a hoistway H. The rope 1,1', 1" is in this embodiment a hoisting rope suspending the load, i.e. the elevator car 5. For this purpose the crowned rope wheels 4,4' are located higher than the elevator car 5. The rope 1,1',1" is in this embodiment furthermore connected with a counterweight 7.

Generally, FIGS. 1, 2 and 3 illustrate examples of cross section with two coating portions 3*a*,3*a*',3*a*" and 3*b*,3*b*',3*b*". An advantage of the cross-section presented in FIG. 1 is that it will bend easily on the crowned circumference, easier for example than the cross-section presented in FIG. 2. If this property is valued, the cross-section presented in FIG. 1 is the preferred one.

Combination of coating portions 3*a*,3*a*',3*a*";3*b*,3*b*',3*b*" of different hardnesses, e.g by combining different polymer material grades, can be achieved with precision by co-extrusion. This manufacturing technology utilizes two or more extruders to melt and deliver a steady volumetric throughput of different polymer material grades to a single extrusion die which will extrude the materials in the desired form.

Generally, the presented solutions have several significant advantages, most of which are based on the increased fleet angle tolerance of the rope. When fleet angle is present, either intentionally or unintentionally, the rope arrives to a rope wheel 4,4' from a direction or departs from a rope wheel 4,4' in direction, which direction is not completely orthogonal to the axis of the rope wheel. With the solutions presented for example one or more of the following advantages can be facilitated in elevators:

- Less stringent installation tolerances (especially rope wheels, bedplate and compensator).
- Crowning width can be decreased due to reduced lateral displacement of rope. This enables narrower rope wheels and fitting more ropes in the same space.
- Alternatively, crowning radius can be increased, which decreases load bearing member stresses and enables smaller diameter rope wheels.
- Increased tolerance against building sway
- Ability to mix several rope batches in a single elevator. One rope replacement becomes easier.
- No need for the special two rope wheel bedplate (in most cases) due to reduced contact length requirement. Reduced inertias and cost, increased rope lifetime.
- No need for the large diverter rope wheels (in most cases) due to reduced contact length requirement. Reduced inertias and cost.
- It might be possible to apply belt in 2:1 systems that have fleet angle
- Easy visual detection of coating wear.

Figure 6:
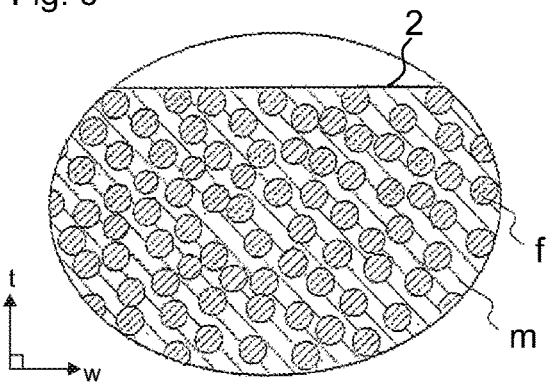
FIG. 6 illustrates an enlarged partial cross-section of the load bearing member as viewed in longitudinal direction of the load bearing member.
Figure 7:
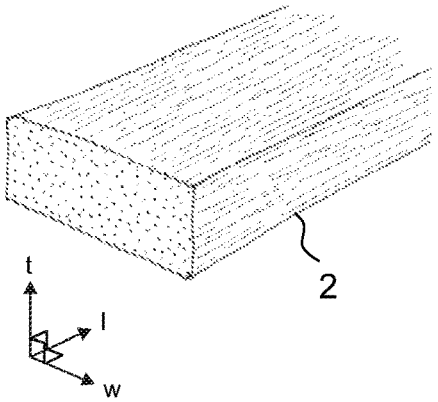
FIG. 7 illustrates preferred details the load bearing member three-dimensionally.

As mentioned, it is preferred that each said load bearing member 2 is made of composite material comprising reinforcing fibers f embedded in polymer matrix m, said reinforcing fibers f preferably being carbon fibers or glass fibers. FIG. 6 illustrates a preferred inner structure of the load bearing member 2, showing inside the circle an enlarged view of the cross section of the load bearing member 2 close to the surface thereof, as viewed in the longitudinal direction 1 of the load bearing member 2. The parts of the load bearing member 2 not showed in FIG. 6 have a similar structure. FIG. 7 illustrates the load bearing member 2 three-dimensionally. The load bearing member 2 is made of composite material comprising reinforcing fibers f embedded in polymer matrix m. The reinforcing fibers fin the polymer matrix m are bound to each other with a polymer matrix m. This has been done e.g. in an earlier manufacturing phase by immersing them together in the fluid material of the polymer matrix which is thereafter solidified. Said immersing can be done by pultrusion of the materials of the matrix m and reinforcing fibers f through a die, for example. The reinforcing fibers f are distributed substantially evenly in polymer matrix m and bound to each other by the polymer matrix m. The load bearing member 2 formed is a solid elongated rod-like one-piece structure. Preferably, substantially all the reinforcing fibers f of each load bearing member 2 are parallel with the longitudinal direction of the load bearing member 2. Thereby, the fibers f are also parallel with the longitudinal direction of the rope 1,1',1" as each load bearing member 2 are to be oriented parallel with the longitudinal direction of the rope 1,1',1". This is advantageous for the rigidity as well as behavior in bending. Owing to the parallel structure, the fibers in the rope 1,1',1" will be aligned with the force when the rope 1,1',1" is pulled, which ensures that the structure provides high tensile stiffness.

The fibers f are preferably substantially untwisted in relation to each other, which provides them said orientation parallel with the load bearing member 2, and finally so with the longitudinal direction of the rope 1,1',1" as well. The reinforcing fibers f are preferably long continuous fibers in the longitudinal direction of the elongated load bearing member 2, preferably continuing unbroken throughout the whole length of the elongated load bearing member 2. As mentioned, the reinforcing fibers f are preferably distributed in the matrix m substantially evenly. The fibers f are then arranged so that the load bearing member 2 would be as homogeneous as possible in the transverse direction thereof. Owing to the even distribution, the fiber density in the cross-section of the elongated load bearing member 2 is substantially constant. The composite matrix m, into which the individual fibers f are distributed, is most preferably made of epoxy, which has good adhesiveness to the reinforcement fibers f and which is known to behave advantageously with reinforcing fibers such as carbon fiber particularly. Alternatively, e.g. polyester or vinyl ester can be used, but other suitable alternative materials could alternatively be used. The matrix m has been applied on the fibers f such that a chemical bond exists between each individual reinforcing fiber f and the matrix m. Thereby a uniform structure is achieved. To improve the chemical adhesion of the reinforcing fiber to the matrix m, in particular to strengthen the chemical bond between the reinforcing fiber f and the matrix m, each fiber can have a thin coating, e.g. a primer (not presented) on the actual fiber structure between the reinforcing fiber structure and the polymer matrix m. However, this kind of thin coating is not necessary. The properties of the polymer matrix m can also be optimized as it is common in polymer technology. For example, the matrix m can comprise a base polymer material (e.g. epoxy) as well as additives, which fine-tune the properties of the base polymer such that the properties of the matrix are optimized. The polymer matrix m is preferably of a hard non-elastomer, such as said epoxy, as in this case a risk of buckling can be reduced for instance. However, the polymer matrix need not be non-elastomer necessarily, e.g. if the downsides of this kind of material are deemed acceptable or irrelevant for the intended use. In that case, the polymer matrix m can be made of elastomer material such as polyurethane or rubber for instance.

As above mentioned, the matrix m of the elongated load bearing member 2 is most preferably hard in its material properties. A hard matrix m helps to support the reinforcing fibers f, especially when the rope bends, preventing buckling of the reinforcing fibers f of the bent rope, because the hard material supports the fibers f efficiently. To reduce the buckling and to facilitate a small bending radius of the elongated load bearing member 2, among other things, it is therefore preferred that the polymer matrix m is hard, and in particular non-elastomeric. The most preferred materials for the matrix are epoxy resin, polyester, phenolic plastic or vinyl ester. The polymer matrix m is preferably such that its modulus of elasticity E is over 2 GPa, most preferably over 2.5 GPa. In this case the modulus of elasticity E is preferably in the range 2.5-10 GPa, most preferably in the range 2.5-4.5 GPa. There are commercially available various material alternatives for the matrix m which can provide these material properties. Preferably over 50% proportion of the area of the cross-section of the elongated load bearing member 2 is of the aforementioned reinforcing fiber, preferably such that 50%-80% proportion is of the aforementioned reinforcing fiber, more preferably such that 55%-70% proportion is of the aforementioned reinforcing fiber, and substantially all the remaining area is of polymer matrix m. Most preferably, this is carried out such that approx. 60% of the area is of reinforcing fiber and approx. 40% is of matrix material (preferably epoxy material). In this way a good longitudinal stiffness for the elongated load bearing member 2 is achieved. As mentioned carbon fiber is the most preferred fiber to be used as said reinforcing fiber due to its excellent properties in hoisting appliances, particularly in elevators. However, this is not necessary as alternative fibers could be used, such as glass fiber, which has been found to be suitable for the hoisting ropes as well. The elongated load bearing member 2 is preferably completely non-metallic, i.e. made not to comprise metal.

Figure 8:
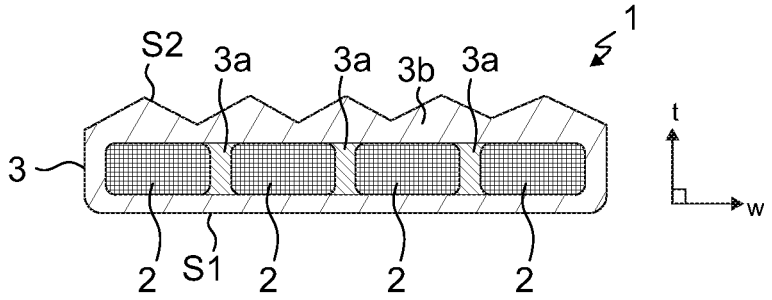
FIGS. 8-10 illustrate a preferred modifications of embodiments of FIGS. 1-3.
Figure 9:
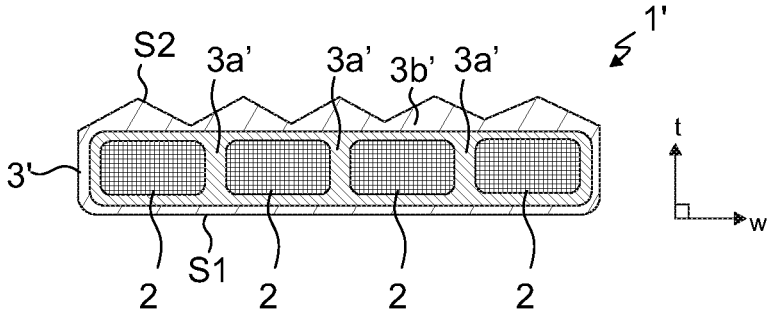
Figure 10:
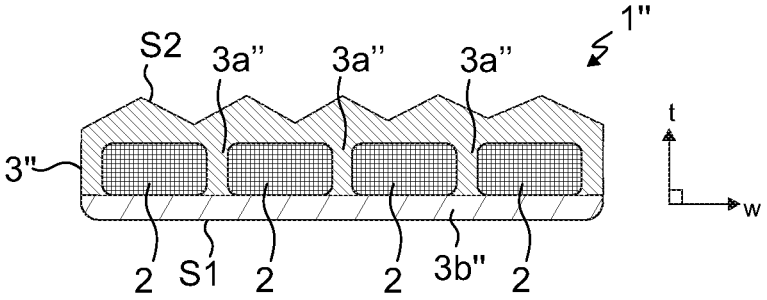

In the preferred embodiments of FIGS. 1-3, an advantageous outer shape of the rope 1,1',1" has been illustrated. However, the invention can also be utilized with ropes that are shaped differently than what is disclosed. Particularly, when only one side S1 of the rope is to be guided by a crowned circumference of a rope wheel, the opposite side S2 can be shaped to have a more freely contoured to have an uneven surface pattern, such as a rib or tooth pattern. Then, this side S2 with a grooved or toothed shape can pass around a circumference of a rope wheel 50 which circumference is shaped to form a counterpart for the shape of the side S2. FIGS. 8-10 illustrate each a preferred modifications of embodiments of FIGS. 1-3. In each case said outer side S1 of the rope 1,1',1" facing in thickness direction t of the rope 1,1',1" and formed by the second coating portion 3*b*,3*b'*,3*b"* is suitable for being placed against a crowned circumference of a rope wheel 4,4'. For this purpose, said outer side S1 is substantially smooth. The smooth side is particularly shaped to be without teeth or longitudinal ribs protruding in thickness direction of the rope 1,1',1". The outer side S2 of the rope 1,1',1" facing in thickness direction t of the rope 1,1',1", which side is opposite to said outer side S1, is contoured to have an uneven surface pattern, in this case a rib pattern, particularly comprising ribs and grooves that are elongated in longitudinal direction of the rope 1,1',1". In the embodiments of FIGS. 8 and 9 the outer side S2 of the rope 1,1',1" facing in thickness direction t of the rope 1,1',1", which side is opposite to said outer side S1, and contoured to have an uneven surface pattern, is formed by the second coating portion 3*b*; 3*b*', whereby the uneven surface pattern is formed by the second coating portion 3*b*; 3*b*'. Thus, the uneven surface pattern is in these embodiments formed of relatively soft material. In the embodiment of FIG. 10 the outer side S2 of the rope 1,1',1" facing in thickness direction t of the rope 1,1',1", which side is opposite to said outer side S1, and contoured to have an uneven surface pattern, is formed by the first coating portion 3*a*", whereby the uneven surface pattern is formed by the first coating portion 3*a*". Thus, the uneven surface pattern is in this embodiment formed of relatively hard material. The ropes 1,1',1" have been presented in FIGS. 8-10 with the same reference numbers as the ropes of FIGS. 1-3 for the sake of clarity and because the only change is in the outer shape of the side S2. The description of structure and implementation of ropes of FIGS. 8-10 as part of the hoisting device (e.g. in FIG. 5) is similar to that of FIGS. 1-3. In the hoisting device, the ropes of FIGS. 8-10, however, have the additional option to be guided with rope wheel 50 presented in FIG. 5 with broken line. Then, this side S2 with a an uneven surface pattern, e.g. groove pattern, is arranged to rest against a circumference of the rope wheel 50 which circumference has an uneven surface pattern forming a counterpart for the uneven surface pattern of side S2.

In the preferred embodiments, an advantageous shape of the load bearing member 2 and an advantageous shape and internal layout of the rope 1,1',1" have been disclosed. However, the invention can also be utilized with ropes which comprise differently shaped load bearing members or a different number of them.

Generally, the rope 1,1',1" presented can be a hoisting rope for suspending a load to be hoisted, as presented in FIG. 5 for instance. However, it can alternatively be a rope of a hoisting device serving some other function than suspending the load. In an elevator such function can be the compensation function and/or the tie down function of the elevator, in which cases the rope interconnects and hangs between the elevator car 5 and counterweight 7, and passes around one or more rope wheels, which are in this case positioned in the bottom end of the hoistway H.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims.

The invention claimed is:

1. A rope arrangement, comprising:

a belt-shaped rope substantially larger in a width direction than a thickness direction thereof, the belt-shaped rope including, two or more load bearing members, and a coating embedding the two or more load bearing members therein, the two or more load bearing members oriented to extend parallel with a longitudinal direction of the belt-shaped rope such that a gap is formed in the width direction between adjacent ones of two or more load bearing members, the coating extending into the gap, the coating including, a first coating portion between the adjacent ones of the two or more load bearing members, the first coating portion including a first material, and a second coating portion forming an outer side of the belt-shaped rope facing the thickness direction, the second coating portion including a second material that is substantially softer than the first material; and a crowned rope wheel including a crowned circumferential surface such that end diameters thereof are smaller than a central diameter thereof, the crowned rope wheel having the belt-shaped rope passing therearound such that the second coating portion forming the outer side of the belt-shaped rope rests against the crowned circumferential surface of the crowned rope wheel, wherein the first coating portion is made of a material having a first Shore A hardness, and the second coating portion is made of material having a second Shore A hardness, wherein the first Shore A hardness is more than Shore A 85.

2. The rope arrangement according to claim 1, wherein the first coating portion between the adjacent ones of the two or more load bearing members is bonded with both of the adjacent ones of the two or more load bearing members to couple the adjacent ones of the two or more load bearing members.

3. The rope arrangement according to claim 1, wherein the first coating portion between the adjacent ones of the two or more load bearing members is a solid one-piece structure extending between the adjacent ones of the two or more load bearing members throughout their lengths.

4. The rope arrangement according to claim 1, wherein the belt-shaped rope is configured to be guided by the crowned circumferential surface of the crowned rope wheel.

5. The rope arrangement according to claim 1, wherein each of the two or more load bearing members is substantially larger in the width direction of the belt-shaped rope than in thickness direction of the belt-shaped rope.

6. The rope arrangement according to claim 1, wherein each of the two or more load bearing members is shaped to have at least one planar side face.

7. The rope arrangement according to claim 1, wherein the two or more load bearing members is made of a composite material including reinforcing fibers embedded in a polymer matrix, the reinforcing fibers being carbon fibers or glass fibers.

8. The rope arrangement according to claim 1, wherein the first coating portion is completely encapsulated within the belt-shaped rope.

9. The rope arrangement according to claim 1, wherein the first coating portion forms a first outer side of the belt-shaped rope, and the second coating portion forms a second outer side of the belt-shaped rope, the second outer side facing the first outer side in thickness direction of the belt-shaped rope.

10. The rope arrangement according to claim 1, wherein the first coating portion and said second coating portion both include a polymer material.

11. The rope arrangement according to claim 1, wherein the first coating portion and the adjacent ones of the two or more load bearing members are surrounded by the second coating portion.

12. The rope arrangement according to claim 1, wherein a second outer side of the belt-shaped rope opposite to the outer side formed by the second coating portion, is contoured to have an uneven surface pattern.

13. A hoisting device comprising:

the rope arrangement of claim 1, wherein the belt-shaped rope is connected with a load to be hoisted.

14. A rope arrangement, comprising:

a belt-shaped rope substantially larger in a width direction than a thickness direction thereof, the belt-shaped rope including, two or more load bearing members, and a coating embedding the two or more load bearing members therein, the two or more load bearing members oriented to extend parallel with a longitudinal direction of the belt-shaped rope such that a gap is formed in the width direction between adjacent ones of two or more load bearing members, the coating extending into the gap, the coating including, a first coating portion between the adjacent ones of the two or more load bearing members, the first coating portion including a first material, and a second coating portion forming an outer side of the belt-shaped rope facing the thickness direction, the second coating portion including a second material that is substantially softer than the first material; and a crowned rope wheel including a crowned circumferential surface such that end diameters thereof are smaller than a central diameter thereof, the crowned rope wheel having the belt-shaped rope passing therearound such that the second coating portion forming the outer side of the belt-shaped rope rests against the crowned circumferential surface of the crowned rope wheel, wherein the first coating portion and the adjacent ones of the two or more load bearing members are surrounded by the second coating portion.

* * * * *